US006228460B1

(12) United States Patent
Hamilton et al.

(10) Patent No.: US 6,228,460 B1
(45) **Date of Patent: *May 8, 2001**

(54) TUFTED ARTICLES AND RELATED PROCESSES

(75) Inventors: Wayne M. Hamilton; Larry E. Mullinax, both of LaGrange, GA (US)

(73) Assignee: Interface, Inc., Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/069,866

(22) Filed: Jun. 1, 1993

(51) Int. Cl.[7] ..... D05C 15/12; D05C 15/34; D05C 15/30

(52) U.S. Cl. ..... 428/88; 428/92; 428/95; 112/80.01; 112/80.4; 112/80.41; 112/80.5; 28/214

(58) Field of Search ..... 112/80.41, 80.55, 112/266.2, 80.5, 410, 80.01, 80.4, 475.23; 28/214; 428/92, 95, 88

(56) References Cited

U.S. PATENT DOCUMENTS

| | | | |
|---|---|---|---|
| Re. 27,165 | | 8/1971 | Spanel et al. . |
| Re. 30,100 | | 9/1979 | Spanel et al. . |
| 2,862,465 | | 12/1958 | Card . |
| 2,989,014 | | 6/1961 | Dedmon . |
| 3,026,830 | | 3/1962 | Bryant et al. . |
| 3,160,125 | | 12/1964 | Bryant et al. . |
| 3,216,387 | | 11/1965 | Short . |
| 3,217,675 | | 11/1965 | Short . |
| 3,220,371 | | 11/1965 | Short et al. . |
| 3,249,078 | | 5/1966 | Nowicki . |
| 3,263,631 | | 8/1966 | Freeman . |
| 3,338,198 | | 8/1967 | Short et al. . |
| 3,375,797 | | 4/1968 | Gaines . |
| 3,396,687 | | 8/1968 | Nowicki . |
| 3,450,076 | | 6/1969 | Bender . |
| 3,595,185 | | 7/1971 | Shorrock et al. . |
| 3,596,617 | * | 8/1971 | Watkins ..... 112/80.41 |
| 3,670,672 | | 6/1972 | Spanel et al. . |
| 3,756,173 | | 9/1973 | Shorrock . |
| 3,812,799 | | 5/1974 | Spanel et al. . |
| 3,820,430 | | 6/1974 | Hautemont . |
| 3,934,524 | | 1/1976 | Smith . |

(List continued on next page.)

FOREIGN PATENT DOCUMENTS

| | | | |
|---|---|---|---|
| 263582 | * | 10/1963 | (AU) ..... 112/80.41 |
| 0483101 | | 4/1992 | (EP) . |

*Primary Examiner*—Blaine Copenheaver
*Assistant Examiner*—Cheryl Juska
(74) *Attorney, Agent, or Firm*—James L. Ewing, IV; Kyle M. Globerman; Kilpatrick Stockton LLP

(57) ABSTRACT

Processes for tufting substrate or primary carpet backing using conventional double needle bars but in which the needles may be shifted less than a full gauge. Processes of the present invention may employ a conventional double needle bar tufting machine to which is added means for shifting or indexing the hook bar laterally to the machine direction of the substrate being tufted. Timing of shifting of the hook bar may be coordinated with timing of shifting of the needle bar and advance of the substrate through the machine to allow piles to be tufted into the substrate at any desired lateral position with respect to previously tufted piles. The invention creates additional pile color pattern alternatives and eliminates repetitive patterns otherwise necessitated by full gauge shifting. Elimination of repeat color sequences reduces matching color sequences on adjoining edges of adjacent carpet tiles made from such substrate which otherwise accentuate or highlight the seams between carpet tiles.

14 Claims, 8 Drawing Sheets

U.S. PATENT DOCUMENTS

| | | | | |
|---|---|---|---|---|
| 3,937,156 | | 2/1976 | Spanel . | |
| 3,937,157 | | 2/1976 | Spanel et al. . | |
| 3,937,158 | | 2/1976 | Spanel . | |
| 3,937,643 | | 2/1976 | Spanel . | |
| 3,943,865 | | 3/1976 | Short et al. . | |
| 3,978,800 | * | 9/1976 | Card et al. | 112/80.43 |
| 3,986,465 | | 10/1976 | Smith et al. . | |
| 4,010,302 | * | 3/1977 | Anderson et al. | 428/95 |
| 4,081,579 | | 3/1978 | Queen et al. . | |
| 4,119,049 | | 10/1978 | Puckett . | |
| 4,127,078 | | 11/1978 | Spanel et al. . | |
| 4,151,805 | | 5/1979 | Long et al. . | |
| 4,216,735 | | 8/1980 | McDaniel, Jr. . | |
| 4,226,196 | | 10/1980 | Booth . | |
| 4,244,309 | | 1/1981 | Spanel et al. . | |
| 4,461,791 | | 7/1984 | Matsui et al. . | |
| 4,522,857 | | 6/1985 | Higgins . | |
| 4,549,496 | | 10/1985 | Kile . | |
| 4,576,665 | | 3/1986 | Machell . | |
| 4,597,344 | | 7/1986 | Stutznacker . | |
| 4,630,558 | * | 12/1986 | Card et al. | 112/266.2 |
| 4,689,256 | * | 8/1987 | Slosberg et al. | 428/95 |
| 4,759,199 | * | 7/1988 | Prichard | 112/80.5 |
| 4,800,828 | | 1/1989 | Watkins . | |
| 4,815,402 | * | 3/1989 | Price | 112/80.44 |
| 4,877,669 | | 10/1989 | Endrenyi, Jr. et al. . | |
| 4,991,523 | | 2/1991 | Ingram . | |
| 5,205,229 | * | 4/1993 | Job | 112/80.41 |

* cited by examiner

TUFTED ARTICLES AND RELATED PROCESSES

This invention relates to processes for tufting articles, such as carpet backing, using a shifting double needle bar and a shifting hook bar.

BACKGROUND OF THE INVENTION

Tufting machines that employ double needle bars are conventionally employed to tuft carpet backing or other substrate. The double needle bars generally feature a front and a back needle bar which are mounted on the same member. A row of needles is mounted to each bar, and the needles in the front row are typically staggered laterally with respect to the needles in the back row. (The needles may be mounted on the same bar.) The member carrying the bars may be actuated at appropriate intervals to cause the front row and back row of needles (and the ends of yarn threaded through them) to penetrate the substrate in order to form two rows of piles simultaneously. An arrangement of hooks is usually mounted on a rocker shaft below the substrate and actuated so that the hooks engage the yarn ends to form the piles as the needles retreat from the substrate.

Double needle bar tufting processes commonly tuft multiple colors of yarn ends in order to form colored pile patterns. For example, the back row of needles may be threaded with a first color and the front row with a second color, in a "two up" process. In a "three up" process, the leftmost needle in the back row may be threaded with a first color, the leftmost needle in the front row with a second color, and the next needle in the back row with a third color. The next needle in the front row carries the first color, the next needle in the back row the second, and the next needle in the front row the third as the yarn color order repeats itself along the rows of needles. "Four up" and "five up" threading patterns feature similar repetitive color orders.

Multicolored threading patterns such as those described above generate repetitive color patterns as the substrate is tufted. A substrate tufted with a non-shifted needle bar in the three up color order described above, for example, features a leftmost line of piles of the first color oriented in the machine direction, followed by a line of second color piles, followed by a third color line. The pile lines repeat the color order across the substrate perpendicular to the machine direction.

The double needle bar may be shifted or "indexed" left and right across the machine direction in order to insert piles of various colors into each line of piles. Thus the double needle bar may be actuated to tuft a front and back row, and then shifted right or left before tufting the next front and back row. The bar may be shifted right or left any number of times as desired according to a predetermined pattern in order to vary the color of piles, and the order in which the colors appear, in each pile line.

It is, however, conventional to index the needle bar the full distance between needles in a front or a back row (a "full gauge"). This is because the hooks which cooperate with the front row of needles are typically of different length than the hooks which cooperate with the back row of needles, so that each back needle must always assume the position previously taken by another back needle when the needle bar is shifted. Similarly, the front needles must always be aligned with a long hook and thus be shifted a full gauge.

Yarn patterns tufted with conventionally shifted double needle bars thus exhibit repetition in the machine direction and across the machine direction, although the repetition is less evident than in patterns generated using non-shifted double needle bars. As an example, a two up conventionally shifted double needle bar generates pile lines of alternating color across the machine direction whether or not the needle bar is indexed during tufting. A four up non-shifted double needle bar generates a repeat of four colors of pile lines, while full gauge shifting the bar successively left and right creates a repeat of two lines of piles, each formed of alternating first and third, and second and fourth, colors. The pattern repeats generated by three and five up arrangements are less evident, but are nevertheless present both in and across the machine direction.

The repetitive nature of patterns created by conventionally shifted double needle bar tufting is amplified when the tufted substrate is converted into carpet tile. In such applications, the substrate is typically cut in the machine direction and across the machine direction as the tiles are formed. A floor covering formed of such tiles may exhibit a "zipper" effect caused by the repeating pattern of colors in edge pile rows or lines on one tile being in alignment with the same repeating pattern on an adjacent tile. Such alignment accentuates the periodic repetition and alignment of dominant colors in the adjacent patterns, and thus highlights the seams between tiles. The effect is sometimes amplified across an entire floor formed of such tiles, as the eye integrates the aligned repetitive patterns across a longer distance. Furthermore, the effect is often more pronounced in tiles formed using a two or four up process, as distinguished from a three or five up process.

SUMMARY OF THE INVENTION

The present invention allows shifting of the double needle bar less than a full gauge in order to create further pile color pattern alternatives, and to break up repetitive patterns that are otherwise necessitated by the double needle bars being previously limited to full gauge shifting. Repeat patterns in pile lines may be avoided or reduced, and the zipper effect in carpet tiles may thus be reduced or eliminated.

Processes of the present invention may employ a conventional double needle bar tufting machine to which is added means for shifting or indexing the hook bar laterally to the machine direction of the substrate being tufted. Shifting of the hook bar may be coordinated with shifting of the needle bar and advance of the substrate through the machine in order to allow piles to be tufted into the substrate at any desired lateral position with respect to previously tufted piles.

Shifting of the hook bar may be accomplished with any number of means. For instance, disclosed in this document is a mechanism that includes followers connected to the hook bar of a conventional tufting machine. The followers track a rotating cam that is geared to and driven by the drive mechanism of the tufting machine. This mechanism causes the hook bar to reciprocate laterally in synchronism with the needle bar as the needle bar follows its tufting pattern. The hook bar may also be indexed using conventional programmable electric, pneumatic, or hydraulic servo means so that it may be shifted left or right successively any number of times, rather than exclusively in reciprocating fashion. Control of the indexing, as in the case of conventional needle bar shifting mechanisms, may be accomplished via conventional programmable devices.

It is therefore an object of the present invention to tuft substrate using a shifting hook bar in order to create additional color pattern alternatives.

It is an additional object of the present invention to tuft carpet backing using a shifting hook bar in order to preclude or reduce repetition of tuft color patterns.

It is an additional object of the present invention to tuft carpet backing in a manner that precludes or reduces the zipper effect in carpet tiles made from the backing.

Other objects, features and advantages of the present invention are apparent with reference to the remainder of this document.

BRIEF DESCRIPTION OF THE DRAWINGS

FIG. 1A is a schematic view of a tufted pile pattern formed by a conventionally indexed (one full gauge in reciprocating fashion) double needle bar in which the front row of needles is threaded with yarn ends of a first color and the back row of needles is threaded with yarn ends of a second color.

FIG. 1B is a schematic view of a tufted pile pattern formed by a double needle bar threaded as in FIG. 1A but in which the double needle bar and the hook bar are indexed one half gauge in reciprocating fashion according to the present invention.

FIG. 1C is a schematic view showing successive needle penetrations to form the pattern shown in FIG. 1B.

DETAILED DESCRIPTION OF THE DRAWINGS

Figure 4B:
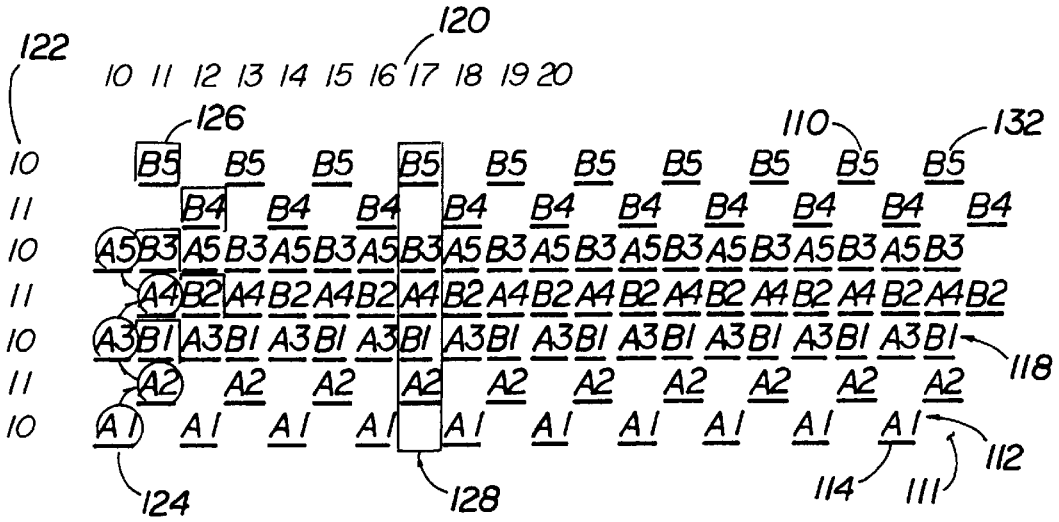
FIGS. 4A and 4B are schematic views of one embodiment of a mechanism for shifting the hook bar of a conventional tufting machine according to one aspect of the present invention.

FIGS. 1A, 1B and 1C schematically show a tufted pile two-color pattern formed conventionally using a shifted double needle bar (FIG. 1A) and also according to the present invention using a shifted double needle bar and a shifted or indexed hook bar (FIG. 1B). As shown in FIG. 1A (and also in FIG. 4B), each needle 110 in back row 112 of needles 110 is threaded (in conventional fashion) with an end 114 of a first color (or colors) "A", so that all back row 112 needles 110 carry the same color ends. Similarly, each needle 110 in front row 116 is threaded (in conventional fashion) with an end 118 of a second color (or colors) "B", so that all front row 116 needles 110 carry the same colored ends. This threading arrangement is known as a "two up" arrangement.

Range 120 at the top of FIGS. 1A, 1B and 1C shows increments in which the needles 110 may be shifted laterally. Such increments may, but need not be, measured in tenths of an inch, so that the range 120 shown at the top of FIGS. 1A, 1B and 1C represents one inch, from position "10" to position "20". FIGS. 1A, 1B and 1C shows an arrangement in which needles 110 in a row 112 or 116 are spaced one fifth of an inch from each other. Other spacings may just as easily be used. For purposes of this document, the space between two needles 110 in a row 112 or 116 is known as a "gauge" or "full gauge". Thus, one fifth inch represents a full gauge in the pattern shown in FIGS. 1A, 1B and 1C show.

Key 122 along the left margin of FIGS. 1A, 1B and 1C shows the range position of the left-most back row 112 needle 110 (back row index needle 124) for each time the needles penetrate the backing or substrate 111 to form a pair of rows 112 and 116. The successive positions of back and front row index needles 124 and 126 are shown by tracks in the figures. As shown in FIG. 1A in a conventional tufting process in which the double needle bar is shifted or indexed left and right in reciprocating fashion, back row index needle 124 is at range position 10 at the first penetration, range position 12 at the second penetration, and range position 10 at the third penetration, as the tufting process continues. Similarly, front row index needle 126 shifts between range positions 11 and 13. The resulting two up conventionally shifted double row pattern of FIG. 1A is successive repeats of lines 128 of alternating colors across the machine direction 130, or in the direction parallel to the rows 112 and 116 of piles 132.

Rows 112 and 116 as shown in FIGS. 1A, 1B and 1C may be "interleaved"; the front row 116 of the first penetration is bracketed by the back row 112 and the front row 116 of the second penetration, so that every back row 112 is adjacent to other back rows 112. The present invention may just as effectively be used in arrangements in which a pair of rows 112 and 116 follows another pair of rows 112 and 116 in non-interleaved fashion.

FIG. 1A shows the effects of indexing constraints imposed by conventionally shifted double needle bar tufting processes. Because the needles 110 are limited to full gauge shifting, piles 132 form alternating lines 128 of color across the substrate 111, and thus accentuate pattern repetition. That repetition can impart a significant effect on the appearance of a floor formed of carpet tiles made of such substrate 111, particularly if the tiles are misaligned or otherwise installed improperly.

Figure 4A:
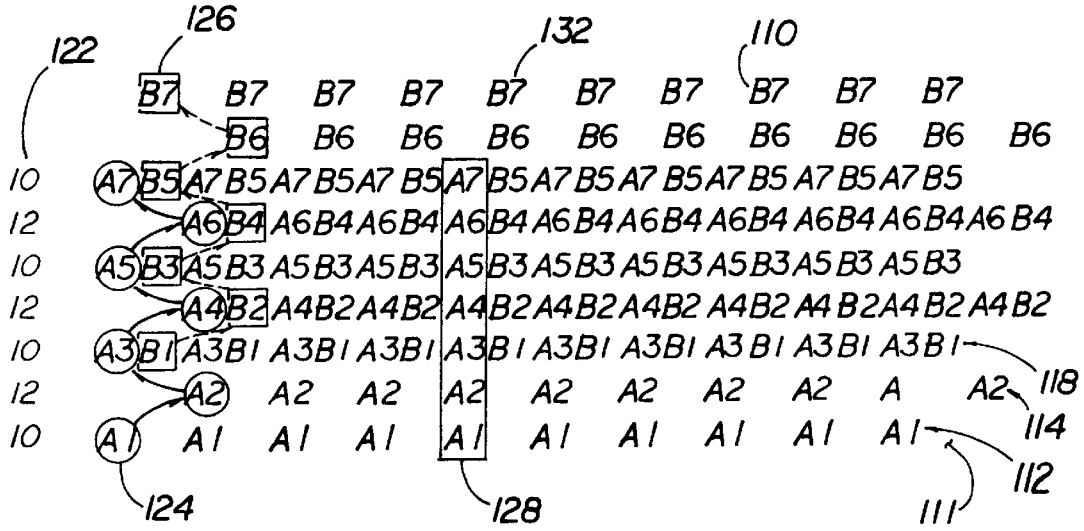
FIG 4A PRIOR ART
Figure 4C:
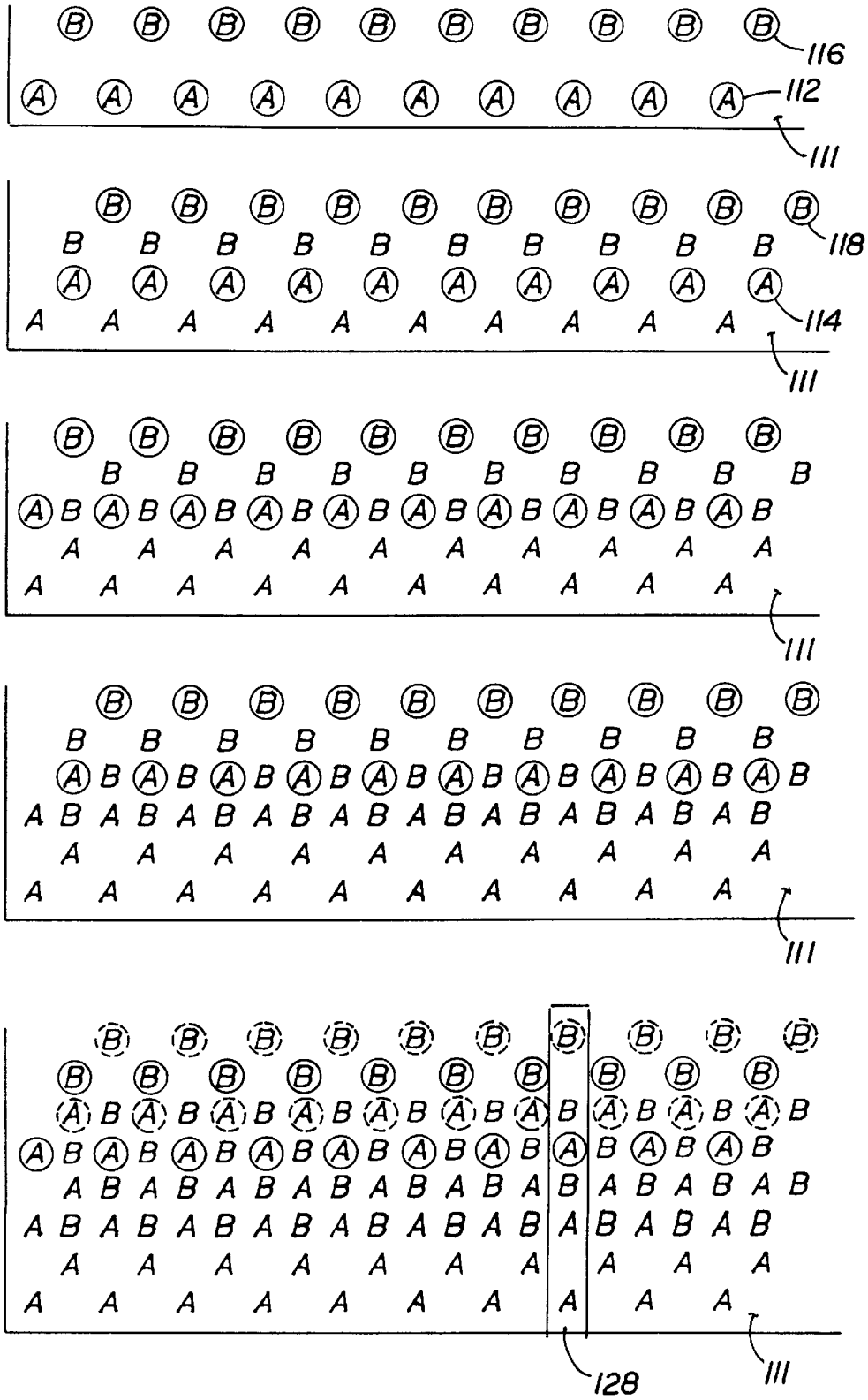

As shown in FIGS. 4A and 4B, full gauge shifting is required in conventional double needle bar tufting processes because of the configuration of the hook bar 134. A first set of shorter hooks 135A extends from the hook bar 134 to capture ends from the back row 112 of needles 110, while a second set of longer hooks 135B extends from the hook bar 134 to capture ends from the front row 116 of needles 110. The shorter hooks, like the needles 110 in the back row 112, are spaced a full gauge apart, as are the longer hooks. The double needle bar must consequently always be shifted a full gauge, so that front needles are always aligned with longer hooks, and back needles are always aligned with shorter hooks.

The present invention, as shown, for example, in FIG. 1B, reduces these indexing constraints. As shown in that figure, the rows 112 and 116 of needles 110 can be shifted any desired fraction of a full gauge and remain in alignment with proper-length hooks, because the hook bar 134 is also shifted. FIG. 1B shows a pattern in which the needles 110 and the hook bar 134 are shifted one-half gauge in reciprocating fashion for each successive penetration of needles 110, between range positions 10 and 11. The resulting pattern features colors A and B in checkerboard design. Shifting the needles 110 and the hook bar 134 one-half gauge creates a pattern that once again features lines 128 of piles 132 in the machine direction 130, but processes according to the present invention need not be so limited. Lines 128 of successive piles 132 are avoided, for instance, by shifting the needle and hook bars other than one-half or a full gauge.

FIG. 1C shows, step by step, successive penetrations of the needles 110 to form the tufted pattern shown in FIG. 1B according to the present invention in which the two colors are checkerboarded by virtue of one-half gauge shifting.

Figure 2A:
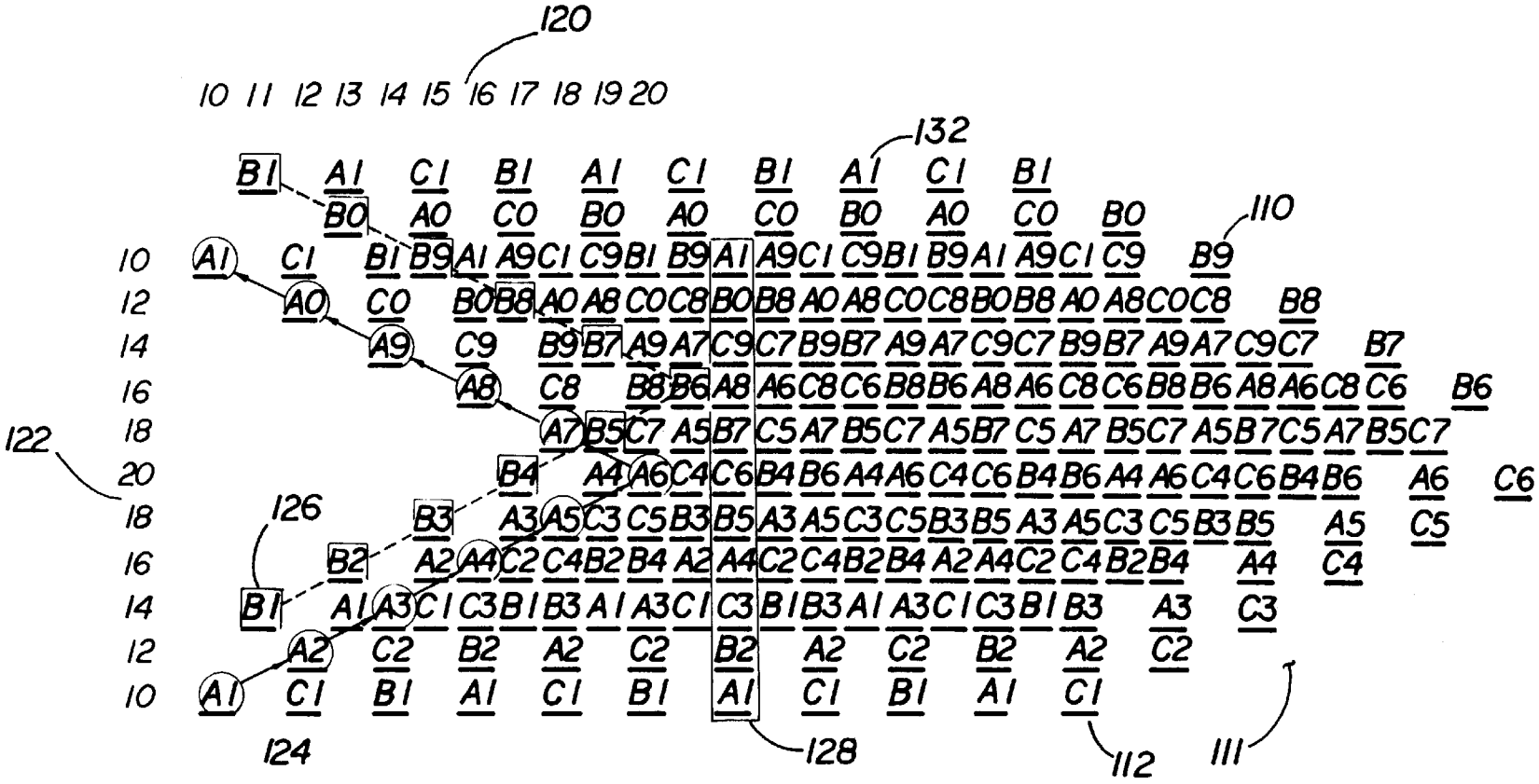
FIG 2A PRIOR ART
FIG. 2A is a schematic view of a tufted pile pattern formed by a double needle bar conventionally indexed one full gauge successively to the right and then left across a range, and in which the front and back rows of needles are threaded in repeating order with yarn ends of a first, second and third color.
Figure 2B:
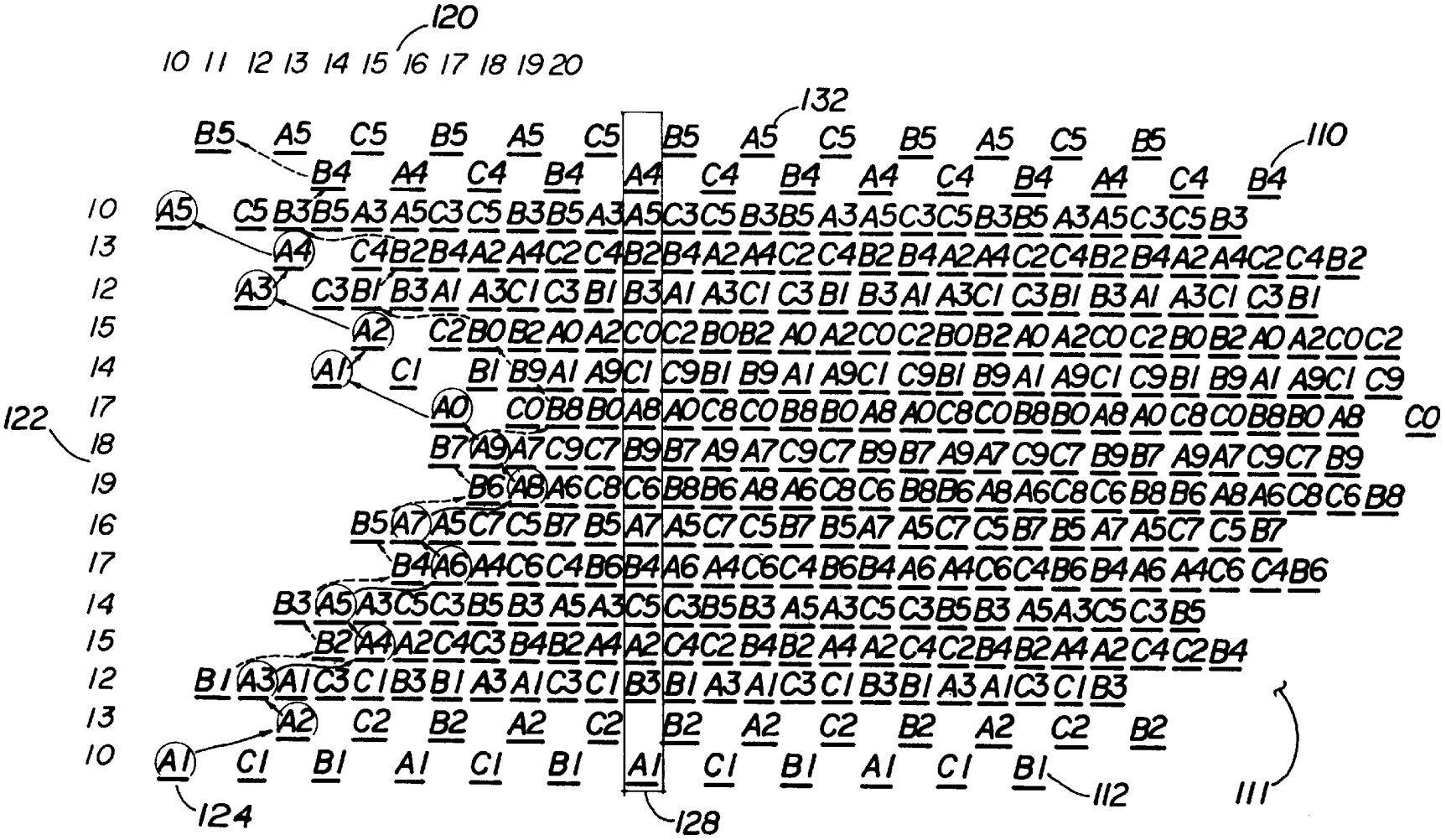
FIG. 2B is a schematic view of a tufted pile pattern formed by a double needle bar threaded as in FIG. 2A, but indexed across a range in one-half and one and one-half gauge successions using a shifting double needle bar and a shifting hook bar according to the present invention.

FIGS. 2A and 2B show a three up arrangement tufted both conventionally and according to the present invention, respectively. Needles 110 in back row 112 and front row 116 are threaded, from left, with a first color "A" (back row index needle 124), second color "B" (front row index needle 126), and third color "C" (the back row needle 110 adjacent to back row index needle 124). The color order or sequence repeats itself with color A on the front row needle 110 adjacent to front row index needle 126, color B on the next back row 112 needle 110, and color C on the next front row 116 needle 110.

FIG. 2A shows a pattern formed by a double needle bar shifted conventionally over a range 120. Colors A, B and C repeat in pairs over the length of each row 112 and 116. The three colors repeat in succession in lines 128 until the shift direction changes, at which point the order of the color succession changes to start a new repeat pattern (from A-B-C to A-C-B at the seventh penetration).

FIG. 2B shows a pattern formed by a double needle bar which is shifted in successions of one-half and one and one-half gauge across range 120 in order to break up the repetitive nature of the pattern of FIG. 2A. The hook bar 134 may simply be shifted in reciprocating fashion so that each short hook aligns with a back row 112 needle and each long hook aligns with a front row 116 needle; similarly, the hook bar can be caused to track the motion of the double needle bar across range 120.

FIG. 2A suggests the potential "zipper" problem which results when carpet tiles are formed from backing that is cut in the machine direction (and transverse to it). Dominant colors appear with constant frequency in lines 128 and also in rows 112 and 116, so that the colors are sometimes aligned and repeat at the same interval or are "in phase" when the lines or rows form the edges of adjacent carpet tiles. This "zipper effect" accentuates and highlights not only the dominant colors that are in phase, but also the seam between tiles. The effect can be even more pronounced across the room, as the eye integrates the synchronized colors over a longer distance.

FIG. 2B illustrates how shifting the double needle bar and the hook bar other than full gauge according to the present invention can introduce discontinuities into color sequences in lines 128 and thus reduce the possibility that two similar or identically ordered lines will form the edges of adjacent carpet tiles.

Figure 3A:
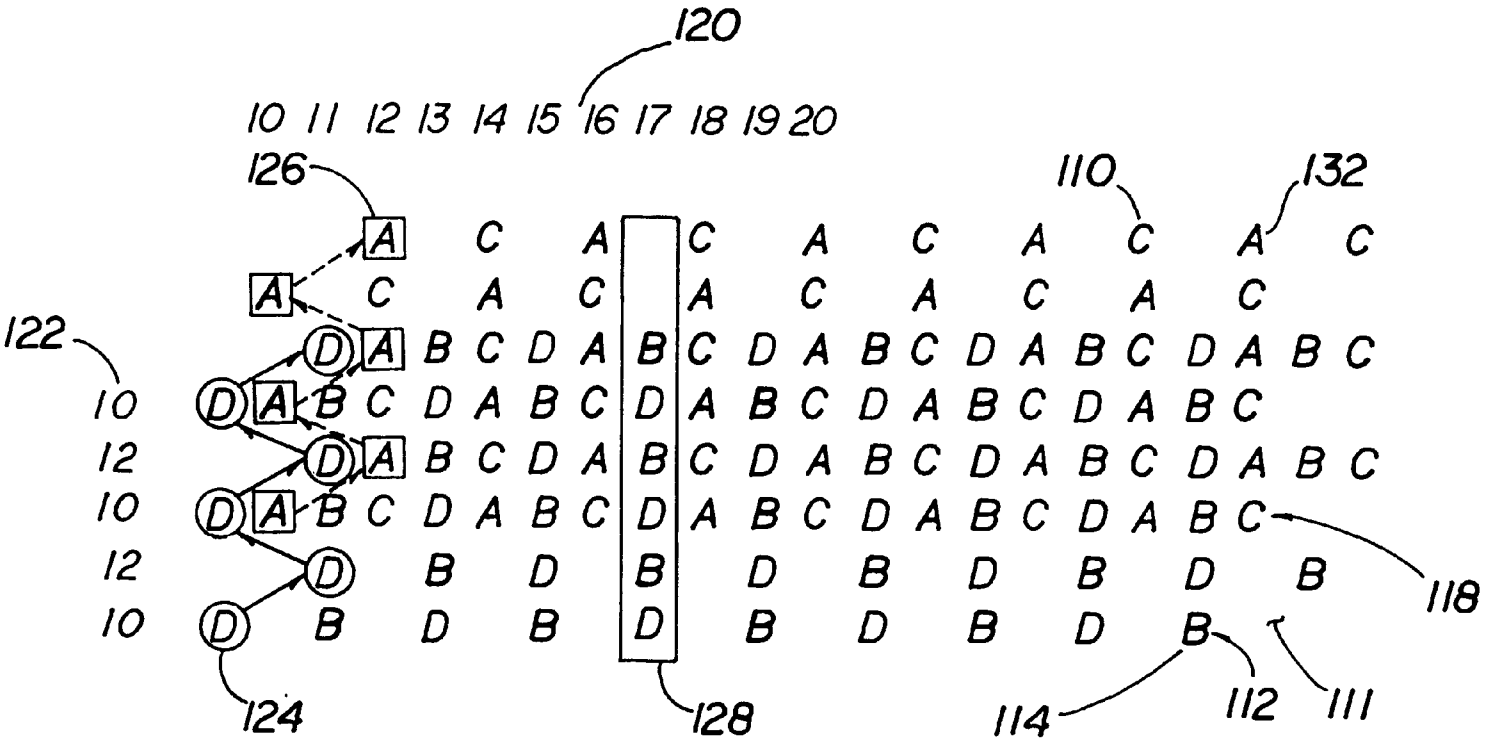
FIG 3A PRIOR ART
FIG. 3A is a schematic view of a tufted pile pattern formed by a conventionally indexed (one full gauge reciprocating) double needle bar in which the front and back rows of needles are threaded in repeating order with four colors of yarn ends.
Figure 3B:
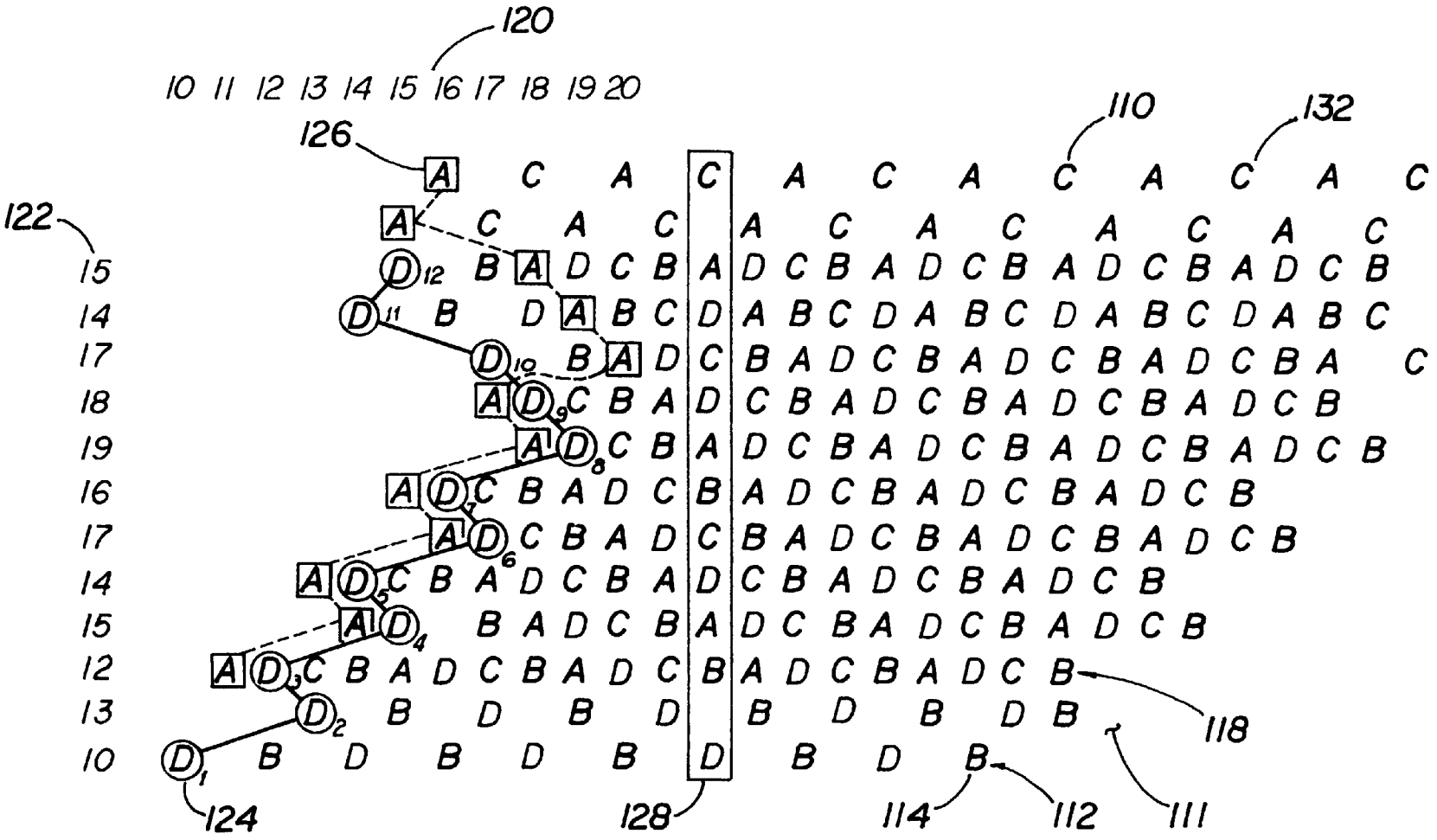
FIG. 3B is a schematic view of a tufted pile pattern formed by a double needle bar threaded as in FIG. 3A, but indexed across a range in one-half and one and one-half gauge successions using a shifting double needle bar and a shifting hook bar according to the present invention.
Figure 4A:
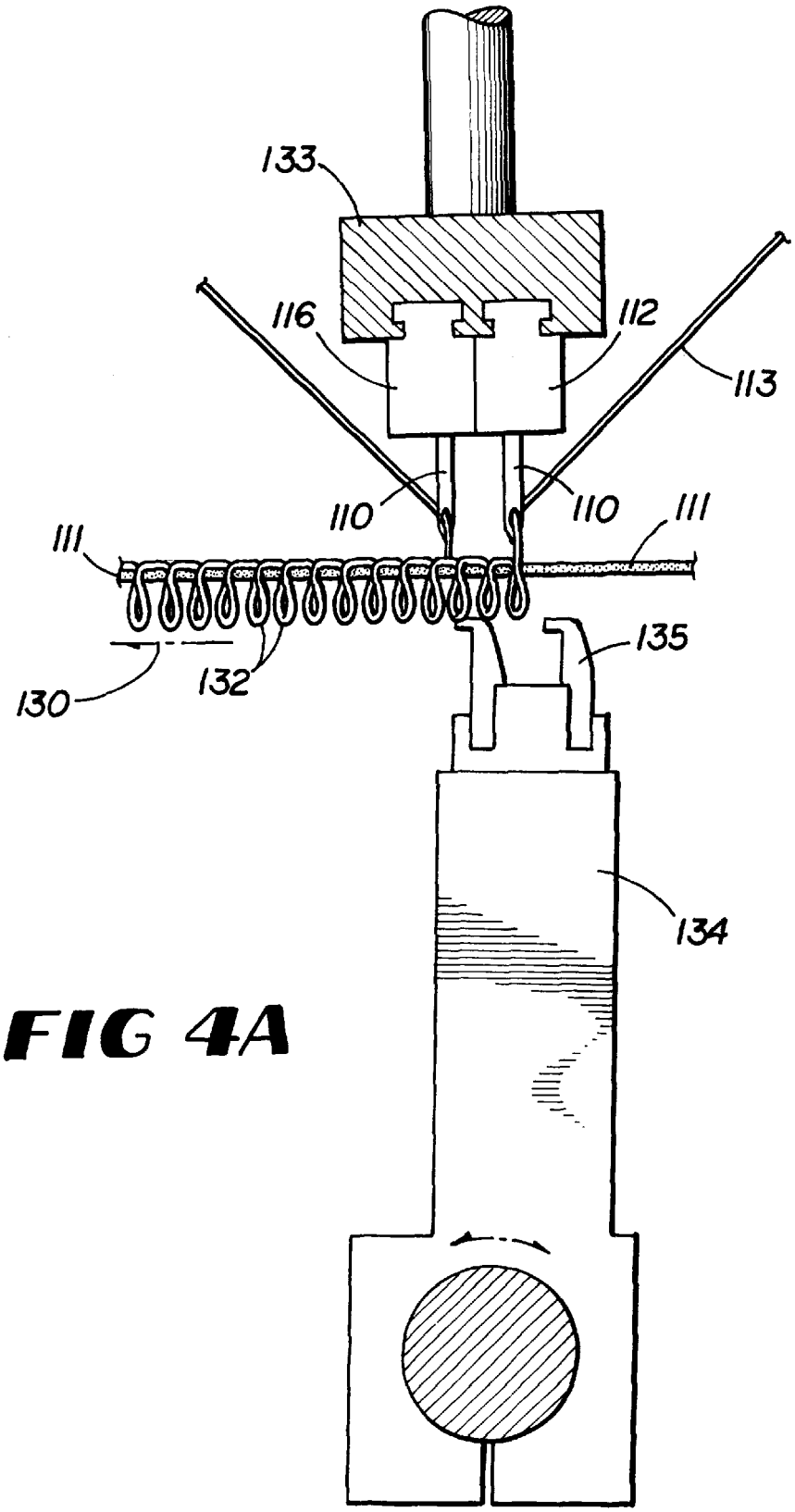
Figure 4B:
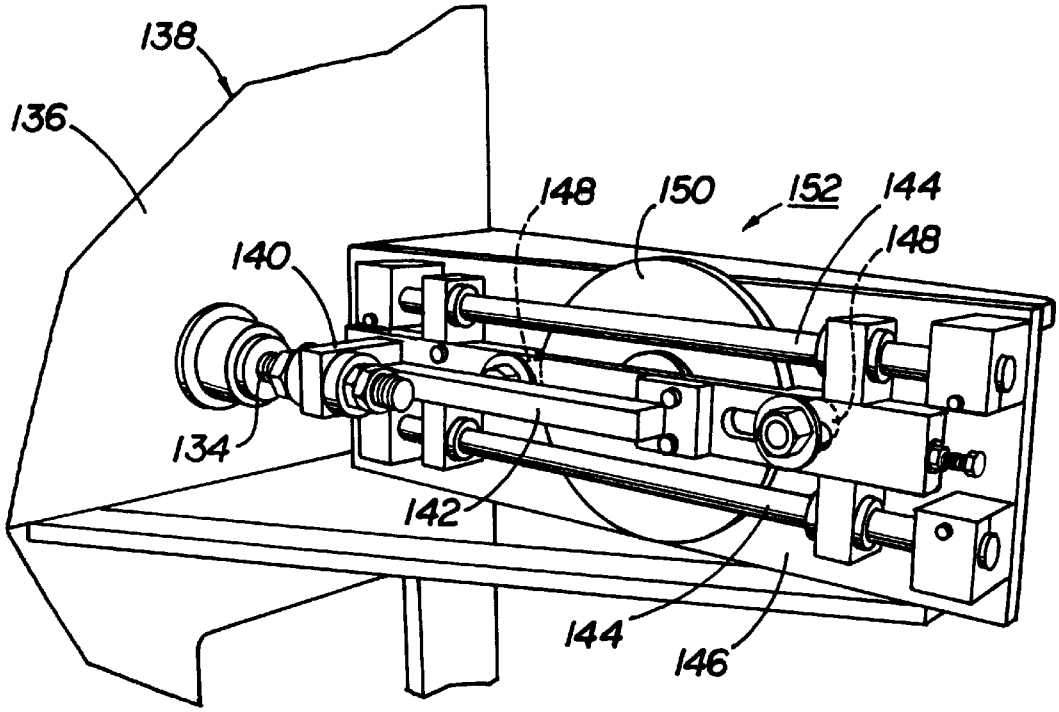

FIGS. 3A and 3B show a four up arrangement. Back row index needle 124 is threaded with color "A", front row index needle 126 with color "B", the next back row needle 110 with color "C" and the next front row needle with color "D" as the color order or sequence repeats itself over rows 112 and 116.

FIG. 3A shows a four up pattern formed by a conventionally reciprocated double needle bar. A first set of alternating lines 128 features colors A and C, while a second set features colors B and D. This pattern, together with the two up pattern shown in FIG. 1A, suggests that the zipper effect, and thus the benefit of the present invention in reducing it, is greater with even up double needle bar conventionally shifted patterns.

FIG. 3B illustrates a four up pattern formed by a double needle bar which is shifted in successions of one-half and one and one-half gauge across range 120 in order to break up the repetitive nature of the patterns of FIG. 3A. There, each of the four colors appears in each line 128, and their order is more random and difficult to predict.

FIGS. 4A and 4B shows one mechanism for shifting or indexing a hook bar according to the present invention. FIG. 4A is a cross sectional view which shows the double needle bar 133 of a conventional tufting machine positioned above substrate 111. Hooks 135A, 135B mounted on hook bar 134 are positioned below the substrate 111. The substrate advances toward the left of the page in machine direction 130, while double needle bar 133 reciprocates up and down to insert ends 113 into substrate 111. The hook bar 134 reciprocates in rocking fashion to cause hooks 135A, 135B to engage and disengage yarn ends 113 in synchronism with needles 110 in order to form piles 132. According to the present invention, not only may the double needle bar 133 be shifted laterally (in and out of the page of FIG. 4A), but the hook bar 134 and thus hooks 135A, 135B may also be so shifted or indexed.

FIG. 4B shows one mechanism for indexing the hook bar 134. As shown in FIG. 4B, hook bar 134 extends from frame 136 of the conventional double needle bar tufting machine 138. The machine 138 shown in FIGS. 4A and 4B may be, for instance, a Cobble "UTPA Graphics" tufting machine supplied by Tufting Machine Company, Inc. of Dalton, Ga. Suitable machines are also provided by Tuftco Corporation of Chattanooga, Tenn. and other vendors. A conventional double needle bar tufting machine is, furthermore, disclosed in U.S. Pat. No. 4,800,828 issued Jan. 31, 1989 to Watkins, entitled "Double Needle Bar Loop Pile Tufting Apparatus," which is incorporated herein by this reference.

Hook bar 134 is mounted in sliding fashion in frame 136, and is otherwise conventionally actuated to rock in reciprocating fashion in synchronism with the action of the double needle bar 133 in order to allow the hooks 135A, 135B to capture ends 113 carried by needles 110. A pillow block 140 mounted to hook bar 134 is attached to a sliding rack 142. The rack 142 is mounted on a pair of guides 144 (carried by a web 146 mounted on the tufting machine frame 136) to slide parallel to the length of hook bar 134. A pair of followers 148 mounted on the rack 142 follows the surface of a rotating cam 150 to cause the rack 142 and, consequently, the hook bar 134, to shift or index laterally to machine direction 130. Cam 150 is turned by a gear and chain drive 152 which is connected to the power source of the tufting machine 138 in a manner that allows cam 150 and thus hook bar 134 to be synchronized with the double needle bar.

The mechanism of FIGS. 4A and 4B causes the hook bar to reciprocate. Other types of cams may be used for such a mechanism, as may other types of actuating means altogether. For instance, a conventional electrically, pneumatically, or hydraulically actuated controller or servo may be employed, such as are commonly used for controlling the double needle bar. Such controllers or servos may be controlled in conventional fashion using programmable devices, in order to govern shifting, indexing and actuation of double needle bars in conventional tufting machines to create desired patterns of piles 132. Conventional computer programs that run on, for instance, an Intel 80286, 386 or 486 based platform in an MS-DOS environment are used in such applications, for example.

Figure 5:
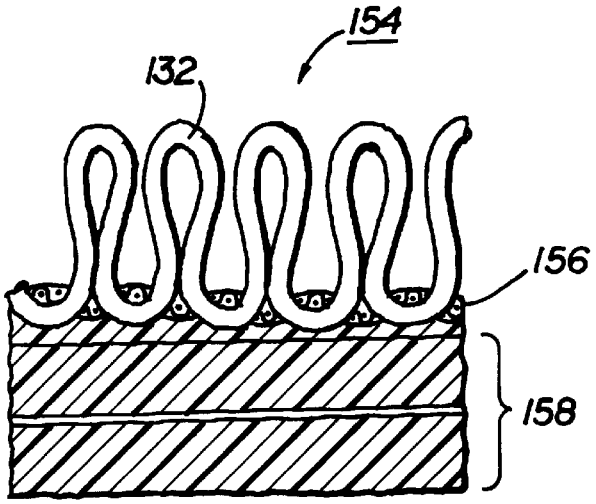
FIG. 5 is a schematic view of a carpet tile formed of substrate tufted according to the present invention.

FIG. 5 shows carpet tile 154 formed from a substrate or primary backing 156 tufted in accordance with the present invention. Tufted primary backing 156 is attached to secondary backing 158 in a conventional manner and cut as desired to form tile 154. Various combinations of plastic layers, stiffening layers, and stabilizing layers may be employed to cause tile 154 to be dimensionally stable and feature appropriate stiffness and floor hugging properties. Processes for forming carpet tiles from tufted primary backing, and tiles so formed, are disclosed, among other places, in the following U.S. patents, which are incorporated herein by this reference: U.S. Pat. No. 4,877,669 issued Oct. 31, 1989 to Endrenyi, Jr. et al., entitled, "Tufted Pile Fabric;" U.S. Pat. No. 4,689,256 issued Aug. 25, 1987 to Slosberg, et al., entitled, "Flame Retardant Tufted Carpet Tile and Method of Preparing Same;" U.S. Pat. No. 4,522,857 issued Jun. 11, 1985 to Higgins, entitled, "Carpet tile with Stabilizing Material Embedded In Adhesive Layer;" U.S. Pat. No. 4,081,579 issued Mar. 28, 1978 to Queen, et al., entitled, "Pile Composite Fabric With Foamed Adhesive;" and U.S. Pat. No. 4,010,302 issued Mar. 1, 1977 to Anderson, et al., entitled, "Tufted Face Carpet Tile."The patents incorporated by reference also disclose the use of a thermoplastic backing layer for providing a stable secondary backing layer. More specifically, U.S. Pat. No. 4,010,302 to Anderson, et al., U.S. Pat. No. 4,689,256 to Slosberg, et al. and U.S. Pat. No. 4,081,579 to Queen, et al. each disclose the use of a secondary rigid, stabilized mass of thermoplastic backing layer. Additionally, U.S. Pat. No. 4,010,302 to Anderson et al. discloses the use of various vinyl chloride resin backing materials for forming the secondary backing layer.

Carpet tile 154 formed with tufted primary backing 156 manufactured according to the present invention is installed in conventional fashion. Such tile has been found to diminish significantly or eliminate entirely any zipper effect which would otherwise occur from repeating color patterns in lines or rows of piles that are in phase with color patterns on adjacent tiles.

The foregoing is provided for purposes of illustration and explanation rather than limitation, and modifications may be made to the disclosed patterns, tufting processes, techniques, substrates, equipment, and carpet tile (or any other subject matter disclosed in this document) without departing from the scope or spirit of the invention.

What is claimed is:

1. A method for forming carpet tiles, comprising the steps of:

a. providing a tufting machine having a shiftable multiple needle bar which comprises a plurality of needles disposed substantially in a plurality of rows, each of which needles is threaded with a yarn end, a first plurality of needles of each row each threaded with a yarn of a first color, a second plurality of needles of each row each threaded with a yarn of a different color than the first color, the needle bar adapted to be actuated so that the needles in each row will penetrate a substrate substantially simultaneously in order to form a plurality of rows of piles on the substrate, the needle bar further adapted to be indexed substantially transversely to the direction in which the substrate travels through the machine;

b. providing the machine with a hook bar which comprises a plurality of hooks, each hook adapted to capture a yarn end threaded through a needle as the needle penetrates the substrate, the hook bar adapted to be indexed substantially transversely to the direction in which the substrate travels through the machine;

c. providing a substrate, advancing it in the machine and actuating the multiple needle bar and the hook bar in order to form a plurality of piles in the substrate;

d. advancing the substrate in the machine; and e. indexing the multiple needle bar and the hook bar a distance other than a full gauge and actuating the multiple needle bar and the hook bar to form a plurality of piles in the substrate ordered in color to break up repetition of piles of the same color in rows of piles oriented on the substrate in a direction transverse to the direction in which the substrate is advanced in the machine;

f. attaching a secondary rigid, stabilized mass of thermoplastic backing layer to the primary backing wherein the secondary backing layer imparts stability and free laying properties to the carpet tile substrate; and g. cutting the substrate in the direction in which the substrate travels through the machine and transverse to the direction in which the substrate travels through the machine to form first and second carpet tiles, the piles along the edges of the first carpet tile being ordered in a different sequence of colors than the piles along the edges of the second carpet tile thereby reducing or eliminating the zipper effect on the carpet tiles.

2. A method according to claim 1 in which the multiple needle bar and the hook bar are indexed more than one full gauge.

3. A method according to claim 1 in which the multiple needle bar and the hook bar are indexed substantially one half gauge.

4. A method according to claim 1 in which the step of indexing the multiple needle bar and the hook bar and actuating the multiple needle bar with the multiple needle bar and the hook bar in the indexed position is accomplished so that one row of needles on the multiple needle bar penetrates the substrate between two rows of piles formed previously in the substrate.

5. A method according to claim 1 comprising the further step of indexing the multiple needle bar one full gauge and actuating the multiple needle bar and the hook bar in order to form a plurality of piles in the substrate.

6. The method of claim 1, wherein the secondary backing is vinyl chloride resin.

7. A method for forming carpet tiles, comprising the steps of:

a. providing a tufting machine having a shiftable double needle bar which comprises a plurality of needles disposed substantially in two rows, the needle bar adapted to be actuated so that the needles in each row will penetrate a substrate substantially simultaneously in order to form a plurality of piles on the substrate, the needle bar further adapted to be indexed substantially transversely to the direction in which the substrate travels through the machine;

b. threading each needle in the double needle bar with a yarn end, a first set of needles in each row threaded with a first set of yarn ends having at least one color, a second set of needles in each row threaded with a second set of yarn ends having at least one color which differs from at least one color of the first yarn ends;

c. providing the machine with a hook bar which comprises a plurality of hooks, each hook adapted to capture a yarn end threaded through a needle as the needle penetrates the substrate, the hook bar adapted to be indexed substantially transversely to the direction in which the substrate travels through the machine;

d. providing a substrate, advancing the substrate in a machine direction in the machine and actuating the double needle bar and the hook bar in order to form a plurality of piles in the substrate;

e. advancing the substrate in the machine;

f. indexing the double needle bar and the hook bar other than a full gauge and actuating the double needle bar and the hook bar to form a plurality of rows of piles in the substrate the piles in the rows ordered in color to break up repetition of piles of the same color in rows of piles oriented on the substrate in a direction transverse to the direction in which the substrate is advanced in the machine;

g. attaching a secondary rigid, stabilized mass of thermoplastic backing layer to the primary backing wherein the secondary backing layer imparts stability and free laying properties to the carpet tile substrate; and h. cutting the substrate in the direction in which the substrate travels through the machine and transverse to the direction in which the substrate travels through the machine to form first and second carpet tiles, the piles along the edges of the first carpet tile being ordered in a different sequence of colors than the piles along the edges of the second carpet tile thereby reducing or eliminating the zipper effect on the carpet tiles.

8. A method according to claim 7 in which the step of indexing the double needle bar and the hook bar and actuating the double needle bar and the hook bar to form a plurality of piles in the substrate comprises indexing the double needle bar and the hook bar substantially multiples of one half the distance between needles in one of the rows.

9. A method according to claim 8 in which the step of indexing the double needle bar and actuating the double needle bar and the hook bar comprises indexing those bars substantially the distance between needles in one of the rows.

10. A method according to claim 7 in which an odd number of colors of ends are used.

11. A method according to claim 7 in which an even number of colors of ends are used.

12. The method of claim 7, wherein the secondary backing is vinyl chloride resin.

13. A method for making carpet tiles, comprising the steps of:

a. providing a tufting machine having a shiftable multiple needle bar which comprises a plurality of needles disposed substantially in a plurality of rows, each of which needles is threaded with a yarn end, a first plurality of needles of each row each threaded with a yarn of a first color, a second plurality of needles of each row threaded with a yarn of a different color than the first color, the needle bar adapted to be actuated so that the needles in each row penetrate a primary backing substantially simultaneously in order to form a plurality of rows of piles on the primary backing, the needle bar further adapted to be indexed substantially transversely to the direction in which the primary backing travels through the machine;

b. providing the machine with a hook bar which comprises a plurality of hooks, each hook adapted to capture an end threaded through a needle as the needle penetrates the primary backing, and which hook bar is adapted to be indexed substantially transversely to the direction in which the primary backing travels through the machine;

c. providing a primary backing, advancing it in the machine and actuating the multiple needle bar and the hook bar in order to form a plurality of piles in the primary backing;

d. advancing the primary backing in the machine;

e. indexing the multiple needle bar and the hook bar a distance other than a full gauge and actuating the multiple needle bar and the hook bar to form a plurality of piles in the primary backing ordered in color to break up repetition of piles of the same color in rows of piles oriented on the substrate in a direction transverse to the direction in which the substrate is advanced in the machine;

f. attaching a secondary rigid, stabilized mass of thermoplastic backing layer to the primary backing wherein the secondary backing layer imparts stability and free laying properties to the carpet tile substrate; and g. cutting the substrate in the direction in which the substrate travels through the machine and transverse to the direction in which the substrate travels through the machine to form first and second carpet tiles, the piles along the edges of the first carpet tile being ordered in a different sequence of colors than the piles along the edges of the second carpet tile thereby reducing or correcting the zipper effect on the carpet tiles.

14. The method of claim 13, wherein the secondary backing is vinyl chloride resin.

* * * * *